US011714375B2

(12) United States Patent
Kimura

(10) Patent No.: US 11,714,375 B2
(45) Date of Patent: Aug. 1, 2023

(54) IMAGE FORMING APPARATUS

(71) Applicant: SHARP KABUSHIKI KAISHA, Sakai (JP)

(72) Inventor: Satoshi Kimura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/749,896

(22) Filed: May 20, 2022

(65) Prior Publication Data

US 2022/0413427 A1 Dec. 29, 2022

(30) Foreign Application Priority Data

Jun. 24, 2021 (JP) ..... 2021-105083

(51) Int. Cl.
*G03G 21/16* (2006.01)
*G03G 21/18* (2006.01)

(52) U.S. Cl.
CPC ..... *G03G 21/1647* (2013.01); *G03G 21/1671* (2013.01); *G03G 21/1676* (2013.01); *G03G 21/1821* (2013.01)

(58) Field of Classification Search
CPC ..... G03G 21/1647; G03G 21/1671; G03G 21/1676; G03G 21/1821
See application file for complete search history.

(56) References Cited

U.S. PATENT DOCUMENTS

2014/0169829 A1* 6/2014 Maeshima ..... G03G 21/1821 399/111
2014/0301753 A1* 10/2014 Fujii ..... G03G 21/1821 399/119
2017/0248869 A1* 8/2017 Matsumoto ..... G03G 21/1647
2020/0272088 A1* 8/2020 Sueshige ..... G03G 21/1647
2022/0066352 A1* 3/2022 Minamoto ..... G03G 21/1821

FOREIGN PATENT DOCUMENTS

JP 4516720 B2 8/2010

* cited by examiner

*Primary Examiner* — Sophia S Chen
(74) *Attorney, Agent, or Firm* — ScienBiziP, P.C.

(57) ABSTRACT

In an image forming apparatus having a drum unit and a developing unit attachable to or detachable from an apparatus body, when the drum unit is inserted into or removed from the apparatus body, operation in the following first to third sections occurs in order or reverse. The first section is a predetermined section on a removal side from the innermost position of the drum unit. In the first section, the developing unit is inserted/removed integrally with the drum unit. In the second section, only the drum unit is inserted or removed. Meanwhile, the developing unit gradually rotates to switch the contact or separated states in conjunction with the insertion or removal of the drum unit. In the third section, only the drum unit is inserted into or removed from the apparatus body while the developing unit is separated.

9 Claims, 17 Drawing Sheets

IMAGE FORMING APPARATUS

BACKGROUND OF THE INVENTION

Field of the Invention

The present disclosure relates to an image forming apparatus having a photoreceptor drum unit and a developing unit attachable to and detachable from an apparatus body.

Description of the Background Art

In recent years, many functional parts of an image forming apparatus are integrated into units and are configured to be attachable/detachable to/from an apparatus body of the image forming apparatus. For example, a photoreceptor drum unit (hereinafter simply referred to as a drum unit) and a developing unit can be attached/detached to/from the apparatus body.

The drum unit and the developing unit are usually attached/detached to/from the apparatus body by inserting/removing the drum unit and the developing unit in a direction parallel to a drum shaft of the photoreceptor drum and a roller shaft of a developing roller (that is, a front-rear direction of the image forming apparatus). However, in the case where the drum unit is inserted or removed independently while the developing unit remains in the apparatus body, and the drum unit and the developing unit remain in contact (that is, the photoreceptor drum and the developing roller remain in contact), a surface of the photoreceptor drum may be scratched.

For this reason, a conventional image forming apparatus is known, which has a structure capable of separating/contacting the developing unit from/with the drum unit by causing the developing unit to rotate and move by a lever operation or the like, and is configured that the drum unit is inserted or removed in a state where the developing unit is separated from the drum unit.

In the above conventional configuration, the structure of causing the developing unit to rotate and move by the lever operation is complicated, which causes problems of an increase in the number of components and associated cost increase. More specifically, the following components are required: a member that transmits movement in the front-rear direction of the apparatus body; a spring that presses the developing unit toward the drum unit; a drive transmission mechanism that follows the movement of the developing unit; a toner transfer unit; and the like.

The present disclosure has been made in view of the above problems and therefore has a purpose of providing an image forming apparatus capable of inserting/removing a drum unit in/from an apparatus body with a simple configuration.

SUMMARY OF THE INVENTION

In order to solve the above problem, an image forming apparatus as a first aspect of the present disclosure is an image forming apparatus having a photoreceptor drum unit and a developing unit attachable to and detachable from an apparatus body, and when the photoreceptor drum unit is inserted into or removed from the apparatus body, operation in the following first to third sections occurs in the stated order or in an order reverse to the stated order, where (1) the first section is a predetermined section on a removal side from an innermost position of the photoreceptor drum unit, and in the first section, the developing unit is inserted or removed integrally with the photoreceptor drum unit;

(2) the second section is a predetermined section on a removal side from the first section, only the photoreceptor drum unit is inserted or removed in the second section, and meanwhile, the developing unit gradually rotates to switch contact or separated states in conjunction with insertion or removal of the photoreceptor drum unit, and when the photoreceptor drum unit is inserted, the developing unit is switched from the separated state to the contact state, and when the photoreceptor drum unit is removed, the developing unit is switched from the contact state to the separated state; and (3) the third section is a predetermined section on a removal side from the second section, and in the third section, only the photoreceptor drum unit is inserted into or removed from the apparatus body in the separated state of the developing unit.

According to the above configuration, in the second section, the developing unit rotates in conjunction with the insertion or removal of the photoreceptor drum unit to switch the separated or contact states. Thus, there is no need to switch between separation and contact of the developing unit by a lever operation or the like. In addition, in the first section, since the developing unit is inserted or removed integrally with the photoreceptor drum unit, a drive transmission mechanism, which is assembled to the apparatus body, or the like does not have to follow rotation of the developing unit (rotation between the contact state and the separated state), and thus a configuration of the apparatus body can be simplified. Therefore, it is possible to simplify a configuration of the image forming apparatus, which contributes to cost reduction.

The image forming apparatus can be configured that one of the developing unit and the photoreceptor drum unit has a taper on a surface side opposing the other unit and that, in the second section, a part of the other unit moves while abutting the taper, thereby applies a rotational force that causes the developing unit to move into the contact state during insertion of the photoreceptor drum unit, and cancels the rotational force during removal of the photoreceptor drum unit.

According to the above configuration, with the simple configuration, the developing unit can rotate in conjunction with the insertion or removal of the photoreceptor drum unit to switch between the separated state and the contact state.

The image forming apparatus can be configured that, at a boundary between the first section and the second section, a photoreceptor drum of the photoreceptor drum unit and a developing roller of the developing unit are positioned by positioning members at both ends in an insertion and removal direction.

According to the above configuration, the photoreceptor drum and the developing roller can be positioned with high precision by the positioning members at both of the ends in the insertion and removal direction.

The image forming apparatus can be configured that the developing unit rotates to a separation side from the photoreceptor drum unit by own weight.

According to the above configuration, the number of components can be reduced by eliminating a member used to rotate the developing unit to the separation side, and the like.

The image forming apparatus can be configured that the developing unit receives an urging force from an elastic member and rotates to a separation side from the photoreceptor drum unit.

According to the above configuration, regardless of a positional relationship between the developing unit and the photoreceptor drum unit, the present disclosure can be applied.

In order to solve the above problem, an image forming apparatus as a second aspect of the present disclosure is an image forming apparatus having a photoreceptor drum unit and a developing unit attachable to and detachable from an apparatus body, and has: a developing unit guide that guides the developing unit in an insertion and removal direction and allows the developing unit at a predetermined position in the insertion and removal direction to rotate in order to switch between a contact state with and a separated state from the photoreceptor drum unit; a taper that is provided to one of the developing unit and the photoreceptor drum unit, is provided on a surface side opposing the other unit, in a state where the developing unit is located at the predetermined position, abuts a part of the other unit during insertion or removal of the photoreceptor drum unit so as to apply a rotational force that causes the developing unit to move into the contact state during the insertion of the photoreceptor drum unit, and cancels the rotational force during the removal of the photoreceptor drum unit, and thereby causes the developing unit to move into the separated state; a positioning member that fixes positions of a developing roller of the developing unit and a photoreceptor drum of the photoreceptor drum unit in a state where the developing unit and the photoreceptor drum unit are in contact with each other; a restriction member that is provided to the apparatus body, restricts movement of the developing unit from the predetermined position to an insertion side in a state where the developing unit and the photoreceptor drum unit are not in contact with each other, and cancels the movement restriction of the developing unit in the state where the developing unit and the photoreceptor drum unit are in contact with each other; and engagement projections that are provided to both of the developing unit and the photoreceptor drum unit, engage with each other at the time of removing the photoreceptor drum unit that is installed in the apparatus body, and can transmit a force in a removal direction from the photoreceptor drum unit to the developing unit while the developing unit moves from a position in an installed state to the predetermined position.

According to the above configuration, when the photoreceptor drum unit is inserted into or removed from the apparatus body, operation in the following first to third sections can occur in the stated order or in an order reverse to the stated order.

(1) The first section is a predetermined section on a removal side from the innermost position of the photoreceptor drum unit. In the first section, the developing unit is inserted or removed integrally with the photoreceptor drum unit. During the insertion, the force in the insertion direction is transmitted from the photoreceptor drum unit to the developing unit by the positioning member. During the removal, the force in the removal direction is transmitted from the photoreceptor drum unit to the developing unit by the engagement projection.

(2) The second section is a predetermined section on a removal side from the first section. In the second section, only the photoreceptor drum unit is inserted or removed. Meanwhile, the developing unit gradually rotates to switch contact or separated states in conjunction with insertion or removal of the photoreceptor drum unit. When the photoreceptor drum unit is inserted, the developing unit is switched from the separated state to the contact state. When the drum unit is removed, the developing unit is switched from the contact state to the separated state. During the insertion, the movement of the developing unit to the insertion side is restricted by the restriction member until the developing unit is switched into the contact state.

(3) The third section is a predetermined section on a removal side from the second section. In the third section, only the photoreceptor drum unit is inserted into or removed from the apparatus body in the separated state of the developing unit.

The image forming apparatus is configured that the developing unit guide includes: a guide groove that is provided at least on an opposite side of the photoreceptor drum unit and is formed in the developing unit; and a developing unit insertion and removal guide provided to the apparatus body, the guide groove has: a first groove in such a length that can guide insertion or removal operation of the developing unit throughout an entire area; and a second groove in such a length that can guide the insertion or removal operation of the developing unit in a predetermined section, the first groove and the second groove are divided in a rotational direction of the developing unit on a front side of the apparatus body and are coupled in the rotational direction of the developing unit on a rear side of the apparatus body, and when the developing unit is at the predetermined position, the developing unit guide causes relative movement of the developing unit insertion and removal guide in the rotational direction at a position between the first groove and the second groove, and can thereby switch between the contact state and the separated state of the developing unit.

The image forming apparatus can be configured that the positioning member includes: a rear positioning member that is provided on a rear side of the developing unit and positions a drum shaft of the photoreceptor drum; and a front positioning member that is provided on a front side of the photoreceptor drum unit and positions a roller shaft of the developing roller.

According to the above configuration, the developing roller and photoreceptor drum can easily be positioned by operation to insert the photoreceptor drum.

The image forming apparatus can be configured that the engagement projection includes: a drum unit-side engagement projection that is provided to the photoreceptor drum unit, has a removal-side tapered surface on a front side, and has an insertion-side tapered surface on a rear side; and a developing unit-side engagement projection that is provided to the developing unit, has a removal-side tapered surface on the rear side, and has an insertion-side tapered surface on the front side, and the removal-side tapered surface has a smaller inclination than the insertion-side tapered surface.

According to the above configuration, when the photoreceptor drum unit is removed, the force is easily transmitted from the photoreceptor drum unit to the developing unit via the removal-side tapered surface of the drum unit-side engagement projection and the developing unit-side engagement projection. In addition, when the photoreceptor drum unit is inserted, the insertion-side tapered surfaces temporarily oppose and contact each other in the middle of the insertion. However, due to the large inclination of the insertion-side tapered surface, the drum unit-side engagement projection can easily ride over the developing unit-side engagement projection along the insertion-side tapered surface.

The image forming apparatus in the present disclosure can exert such an effect that the configuration of the image forming apparatus can be simplified since there is no need to switch between the separation and the contact of the developing unit by the lever operation or the like, and since the drive transmission mechanism, which is assembled to the apparatus body, or the like does not have to follow the rotation of the developing unit (the rotation between the contact state and the separated state).

DESCRIPTION OF THE PREFERRED EMBODIMENTS

First Embodiment

Figure 1:
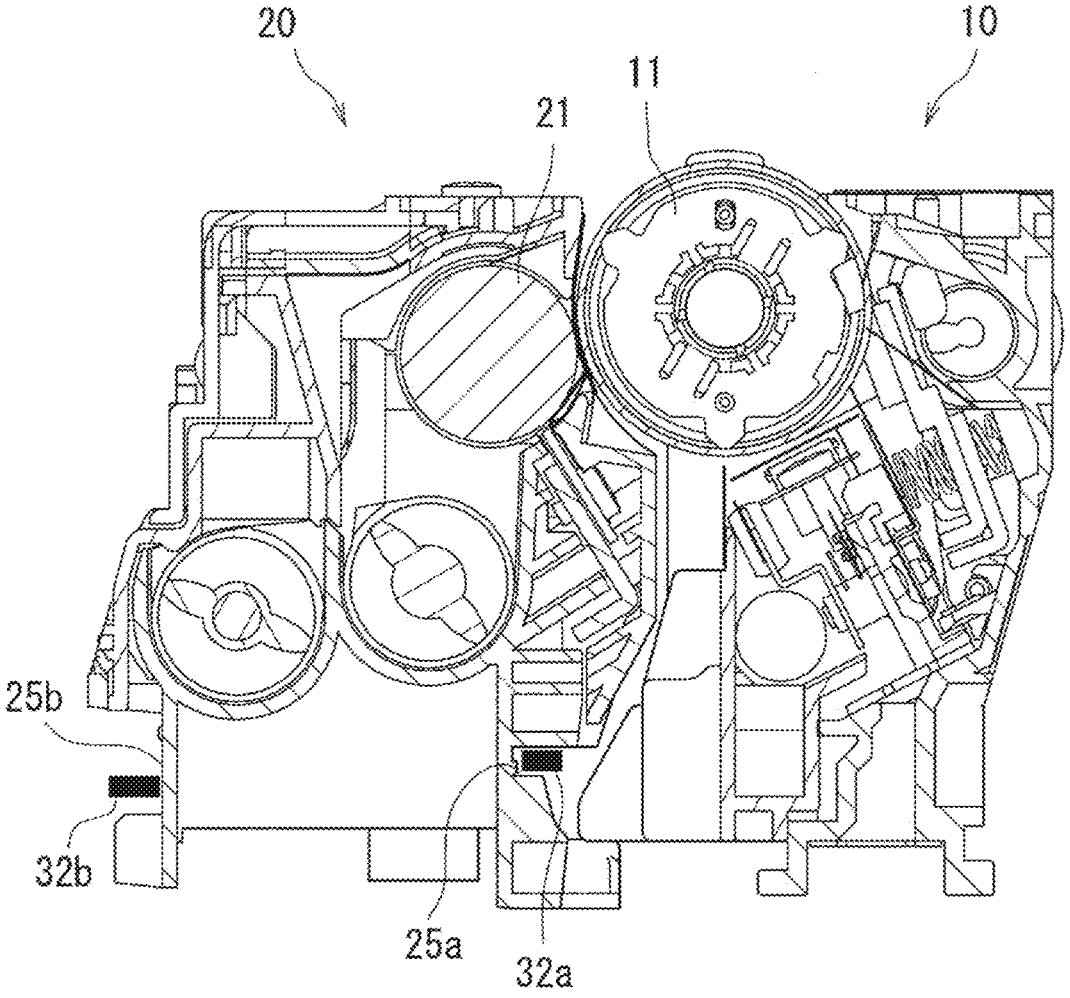
FIG. 1 is a cross-sectional view illustrating a drum unit and a developing unit removed from an image forming apparatus according to an embodiment, and illustrates a state where the developing unit is in contact with the drum unit.
Figure 2:
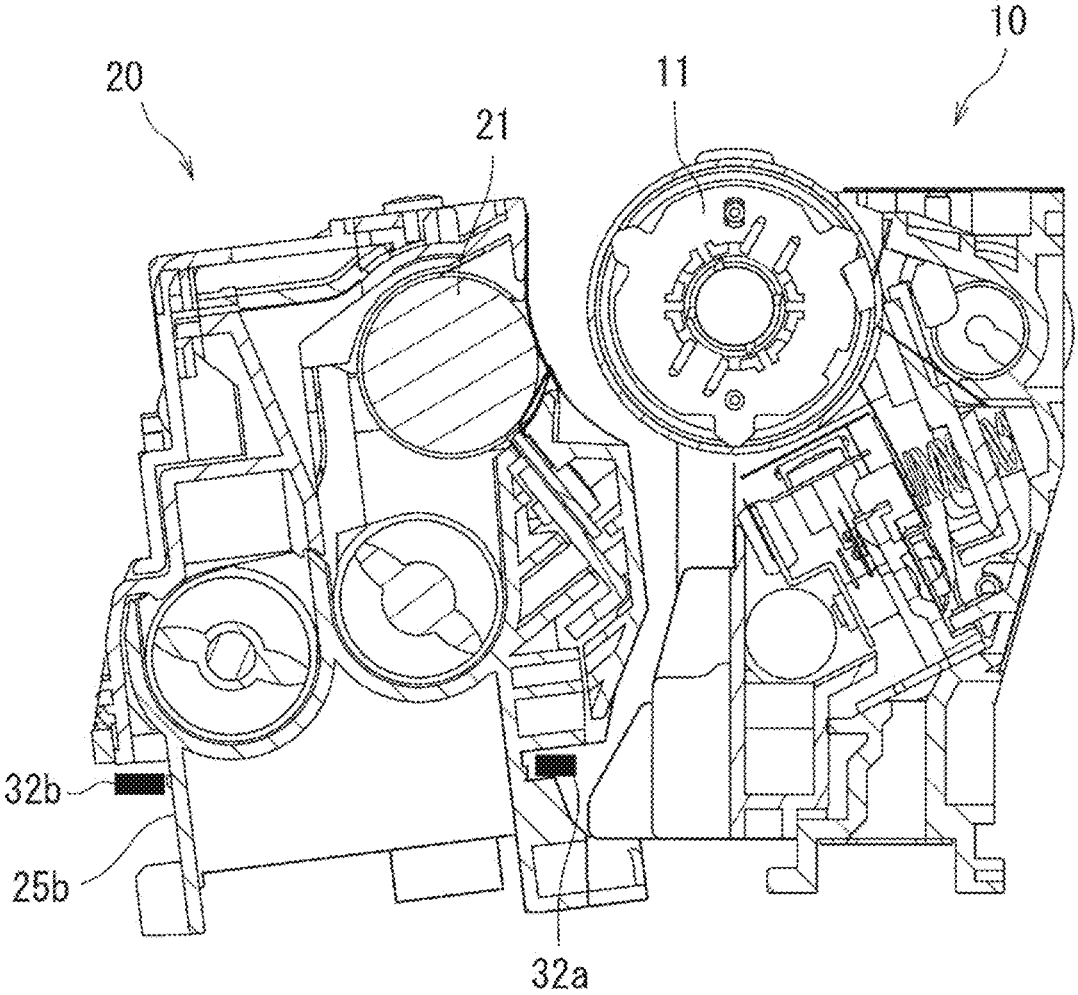
FIG. 2 is a cross-sectional view illustrating the drum unit and the developing unit removed from the image forming apparatus according to the embodiment, and illustrates a state where the developing unit is separated from the drum unit.

A detailed description will hereinafter be made on an embodiment of the present disclosure with reference to the drawings. FIG. 1 and FIG. 2 are cross-sectional views illustrating a drum unit (a photoreceptor drum unit) 10 and a developing unit 20 removed from an image forming apparatus (hereinafter referred to as this apparatus) according to this first embodiment. Here, the drum unit 10 of this apparatus can be inserted into or removed from an apparatus body in a front-rear direction (removed from a front side). FIG. 1 illustrates a state where the developing unit 20 is in contact with the drum unit 10 (a contact state), and FIG. 2 illustrates a state where the developing unit 20 is separated from the drum unit 10 (a separated state).

For example, in a state where the drum unit 10 is completely installed in this apparatus, as illustrated in FIG. 1, a photoreceptor drum 11 in the drum unit 10 and a developing roller 21 in the developing unit 20 are in a mutually contact state (strictly speaking, the photoreceptor drum 11 and the developing roller 21 are in close proximity with a slight gap therebetween, but are expressed to be in the contact state). A drum shaft 111 of the photoreceptor drum 11 and a roller shaft 211 of the developing roller 21 are arranged in the front-rear direction of this apparatus, that is, in parallel with an insertion and removal direction of the drum unit 10. The drum unit 10 is linearly removed from the apparatus body (not illustrated) along a drum shaft 111 direction.

In the case where the drum unit 10 is inserted/removed independently in/from this apparatus and the drum unit 10 is inserted or removed in the contact state with the developing unit 20, the photoreceptor drum 11 comes into contact with the developing roller 21, and surfaces thereof rub against each other. As a result, the surfaces of the photoreceptor drum 11 and the developing roller 21 may be scratched. For this reason, this apparatus is configured that operation in the following first to third sections occurs in the stated order or in an order reverse to the stated order when the drum unit 10 is inserted into or removed from the apparatus body. In other words, when the drum unit 10 is inserted, the operation in the third to first sections occurs in order, and, when the drum unit 10 is removed, the operation in the first to third sections occurs in order.

(1) The first section is a predetermined section on a removal side from the innermost position of the drum unit 10. In the first section, the developing unit 20 is inserted or removed integrally with the drum unit 10.

(2) The second section is a predetermined section on a removal side from the first section. In the second section, only the drum unit 10 is inserted or removed. Meanwhile, the developing unit 20 gradually rotates to switch the contact or separated states in conjunction with the insertion or removal of the drum unit 10. When the drum unit 10 is inserted, the developing unit 20 is switched from the separated state to the contact state. When the drum unit 10 is removed, the developing unit 20 is switched from the contact state to the separated state.

(3) The third section is a predetermined section on a removal side from the second section. In the third section, only the drum unit 10 is inserted into or removed from the apparatus body in the separated state of the developing roller 21.

Next, a detailed description will be made on the insertion or removal operation of the drum unit 10 with reference to FIG. 3 to FIG. 15. Since the insertion operation and the removal operation of the drum unit 10 are opposite from each other, the insertion operation will mainly be exemplified in the following description.

Figure 3:
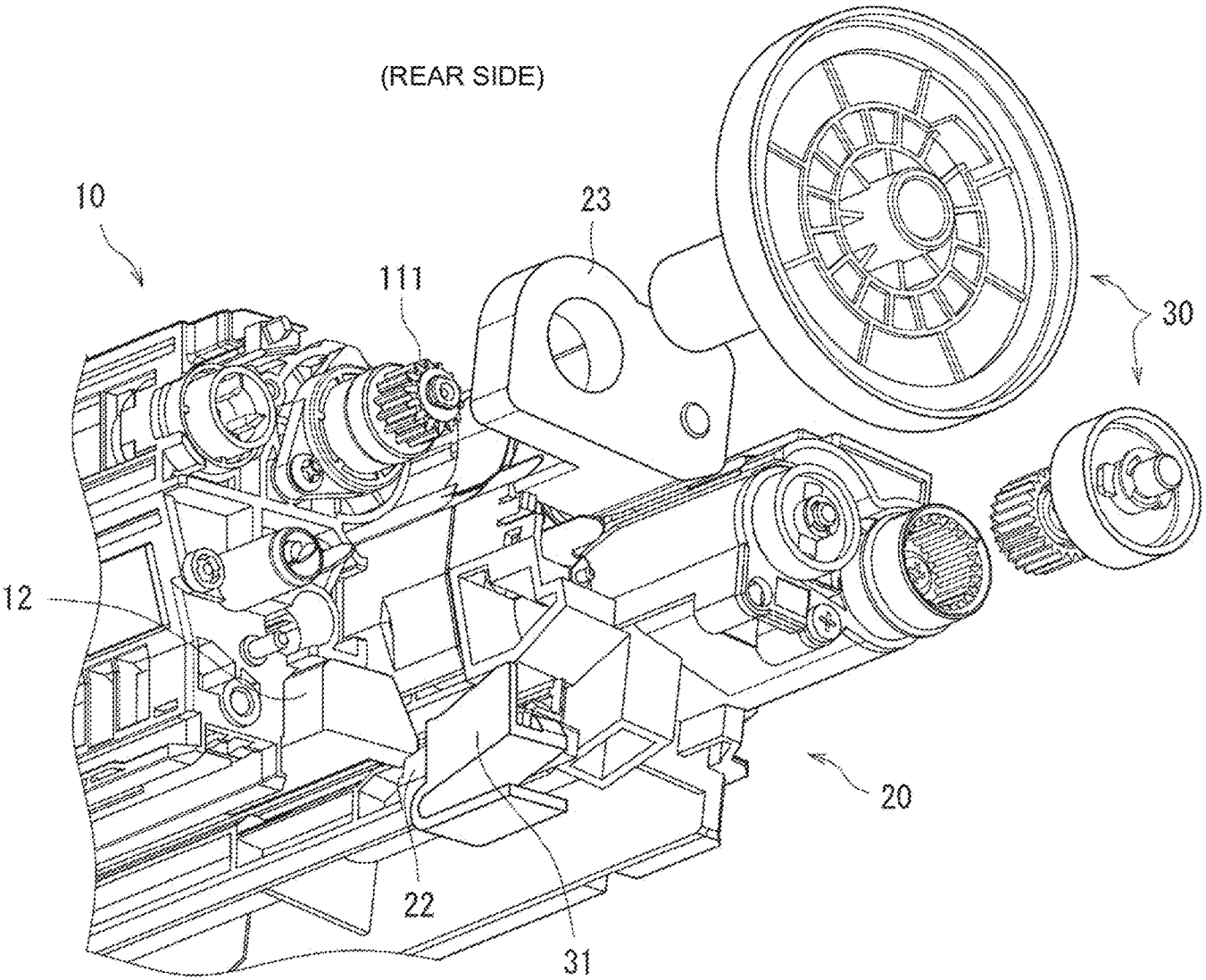
FIG. 3 is a perspective view illustrating rear ends of the drum unit and the developing unit in a first state.
Figure 4:
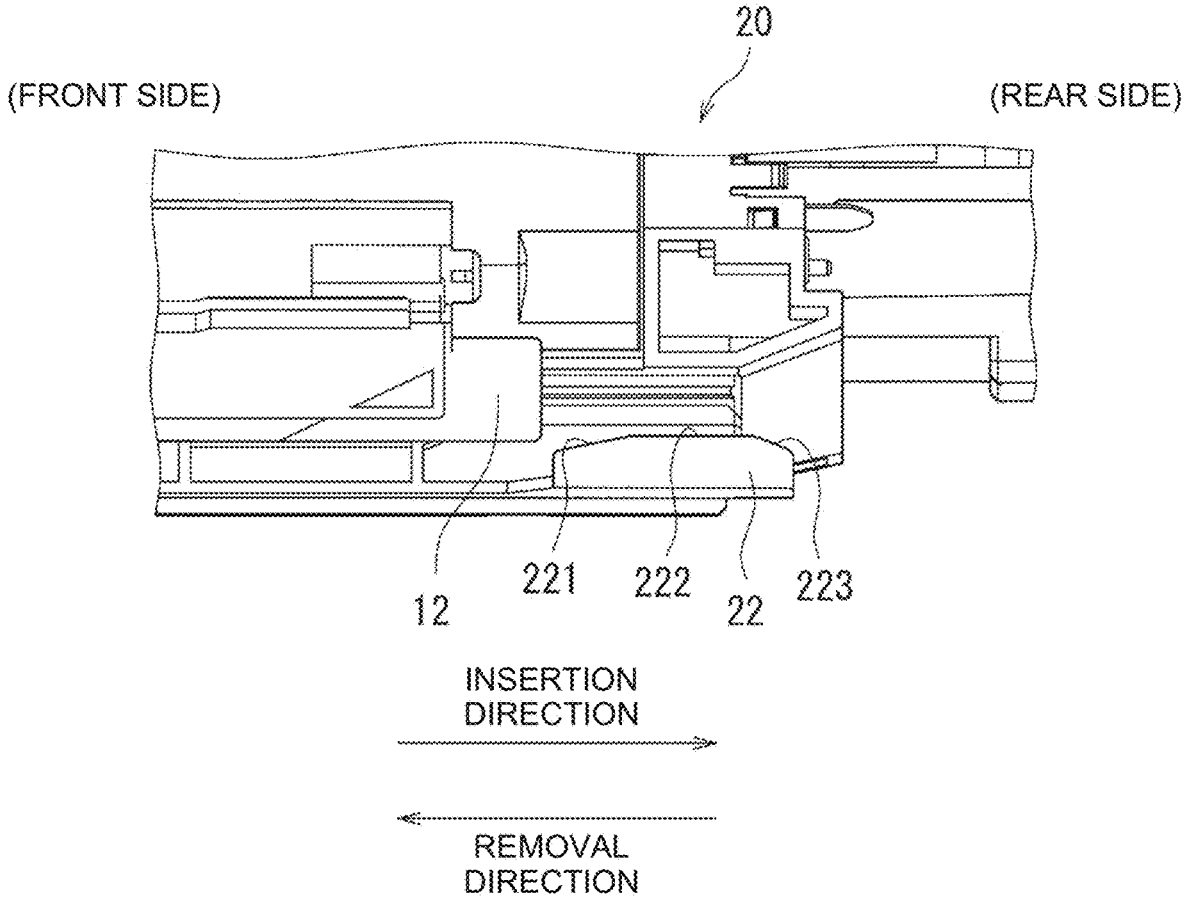
FIG. 4 is a side view in which the developing unit and a foot member of the drum unit in the first state are seen from the drum unit side.
Figure 5:
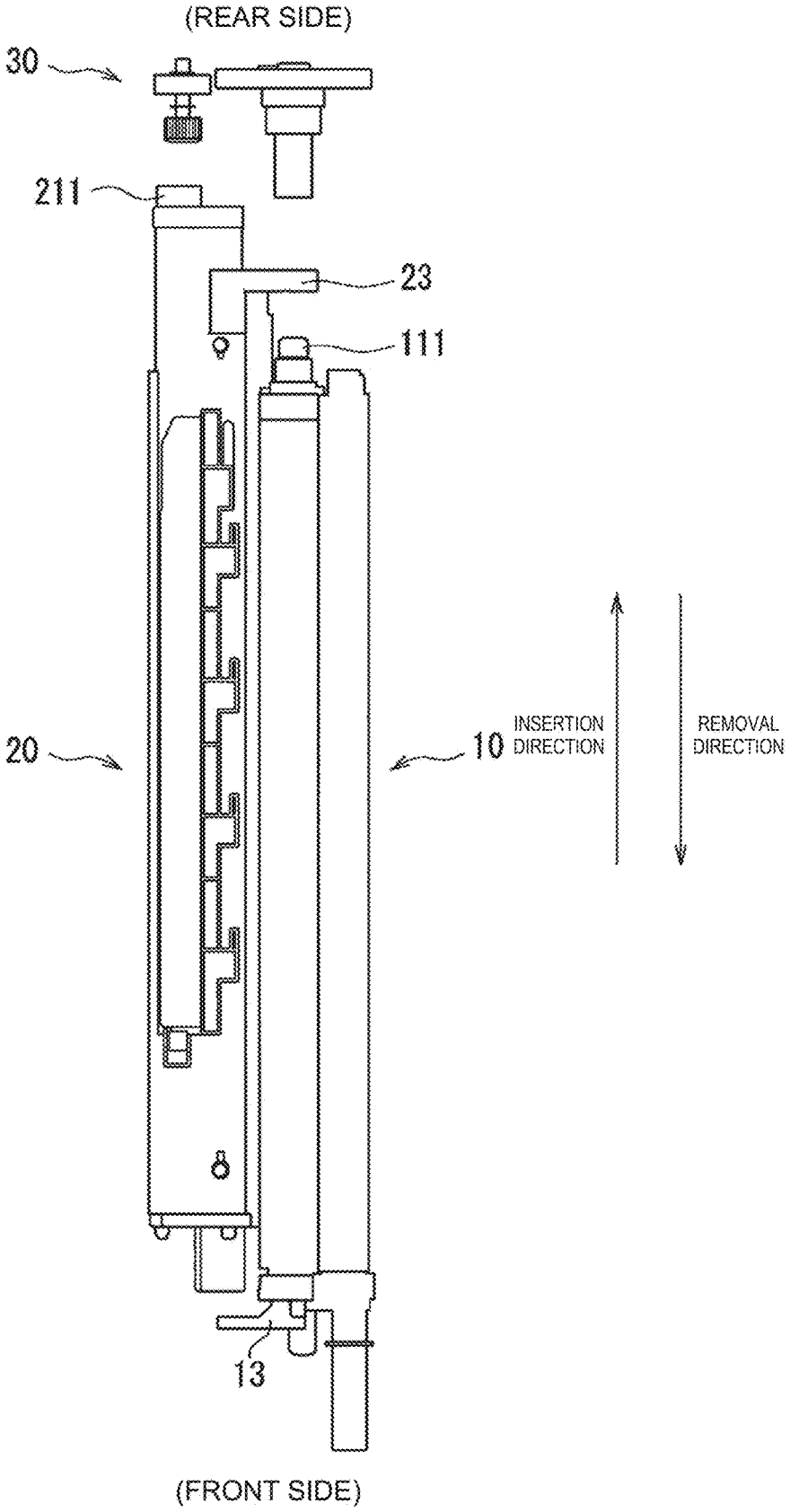
FIG. 5 is a top view of the drum unit and the developing unit in the first state.

FIG. 3 to FIG. 5 each illustrate a state (a first state) immediately before the developing unit 20 starts rotating (rotating from the separated state to the contact state) in association with the insertion of the drum unit 10. FIG. 3 is a perspective view illustrating rear ends of the drum unit 10 and the developing unit 20. FIG. 4 is a side view in which the developing unit 20 and a foot member 12 of the drum unit 10 are seen from the drum unit 10 side. FIG. 5 is a top view of the drum unit 10 and the developing unit 20. In addition to the drum unit 10 and the developing unit 20, FIG. 3 and FIG. 5 also partially illustrate, as a mechanism on the apparatus body side, a drive transmission mechanism 30 that transmits drive power to the photoreceptor drum 11 and the developing roller 21. Furthermore, FIG. 3 illustrates a restriction member 31 that restricts the insertion or removal of the developing unit 20.

In the developing unit 20, an abutter 22 (see FIG. 4) is provided on a surface side opposing the drum unit 10. Along the front-rear direction of this apparatus, this abutter 22 continuously has a first tapered surface (a taper) 221, a flat surface 222, and a second tapered surface 223 in this order from the front. The first tapered surface 221 is a tapered surface that is inclined upward and rearward from the front side. The flat surface 222 is a surface that is parallel to the front-rear direction of this apparatus. The second tapered surface 223 is a tapered surface that is inclined downward and rearward from the front side.

In the drum unit 10, the foot member 12 (see FIGS. 3 and 4) is provided on an opposing surface side with the developing unit 20. In the first state, the foot member 12 is located right in front of the abutter 22, and the foot member 12 does not abut the abutter 22. At this time, the developing unit 20 is in the separated state from the drum unit 10 (that is, the state illustrated in FIG. 2). In addition, in this apparatus, the separated state is maintained by own weight of the developing unit 20.

The drum unit 10 is generally inserted in the apparatus body before reaching the first state, and an insertion section up to the first state (in the case of the removal operation, a removal section from the first state) corresponds to the above-described third section. In other words, from a start of the insertion of the drum unit 10 in the apparatus body to the first state (most of the insertion operation), the developing unit 20 is in the separated state from the drum unit 10. Accordingly, the photoreceptor drum 11 and the developing roller 21 do not contact each other, and the surfaces of the photoreceptor drum 11 and the developing roller 21 are not scratched.

When the drum unit 10 is pressed in the insertion direction from the first state, the foot member 12 advances rearward while abutting the first tapered surface 221 of the abutter 22. In this way, the foot member 12 acts to push down the abutter 22 (applies a rotational force to cause movement of the developing unit 20 into the contact state). The developing unit 20 rotates and rises in such a direction that the developing roller 21 comes into contact with the photoreceptor drum 11. During the removal operation of the drum unit 10, when the foot member 12 advances forward while abutting the first tapered surface 221 of the abutter 22, the rotational force that causes the movement of the developing unit 20 into the contact state is canceled, and the developing unit 20 is brought into the separated state by the own weight.

Figure 6:
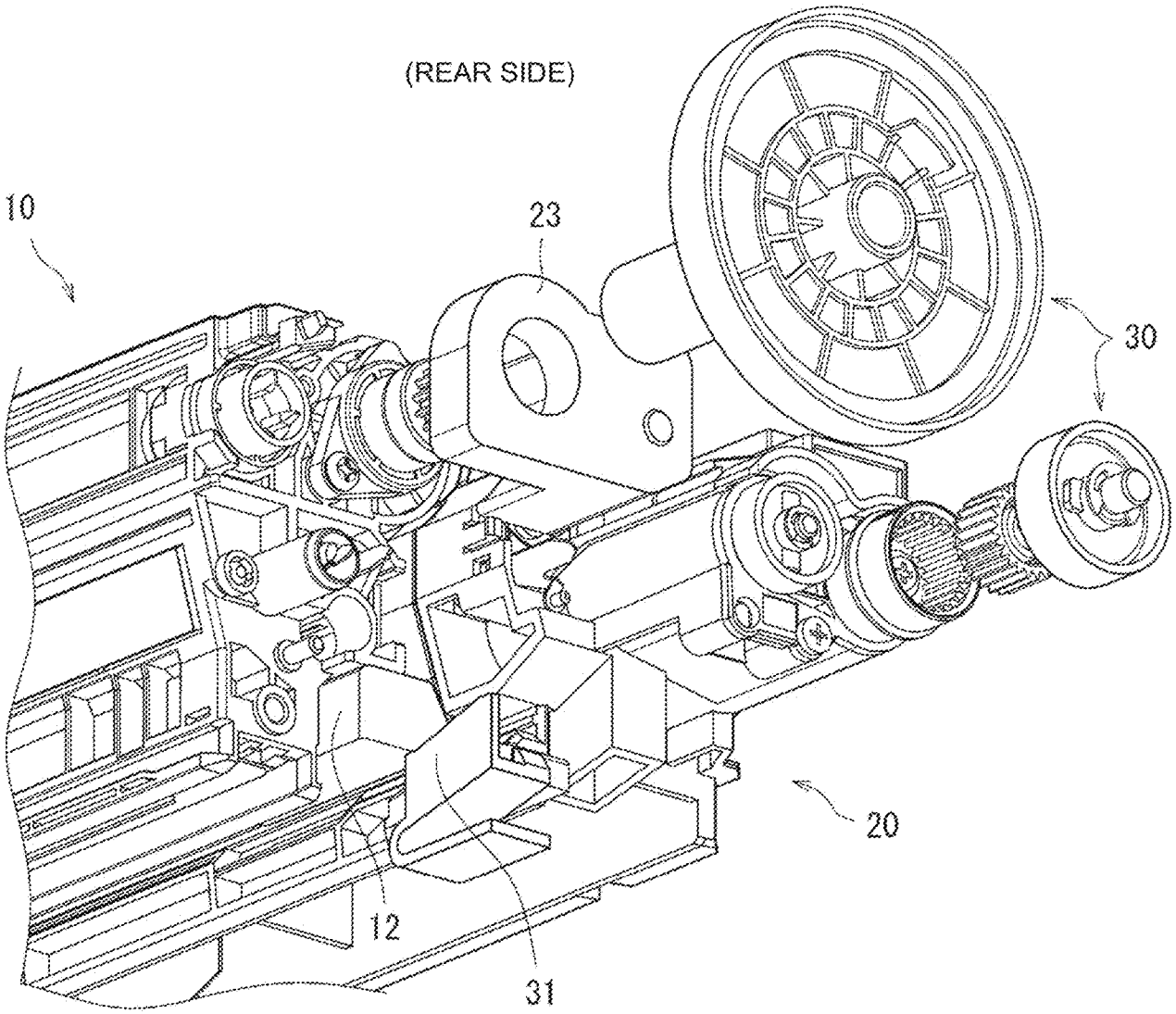
FIG. 6 is a perspective view illustrating the rear ends of the drum unit and the developing unit in a second state.
Figure 7:
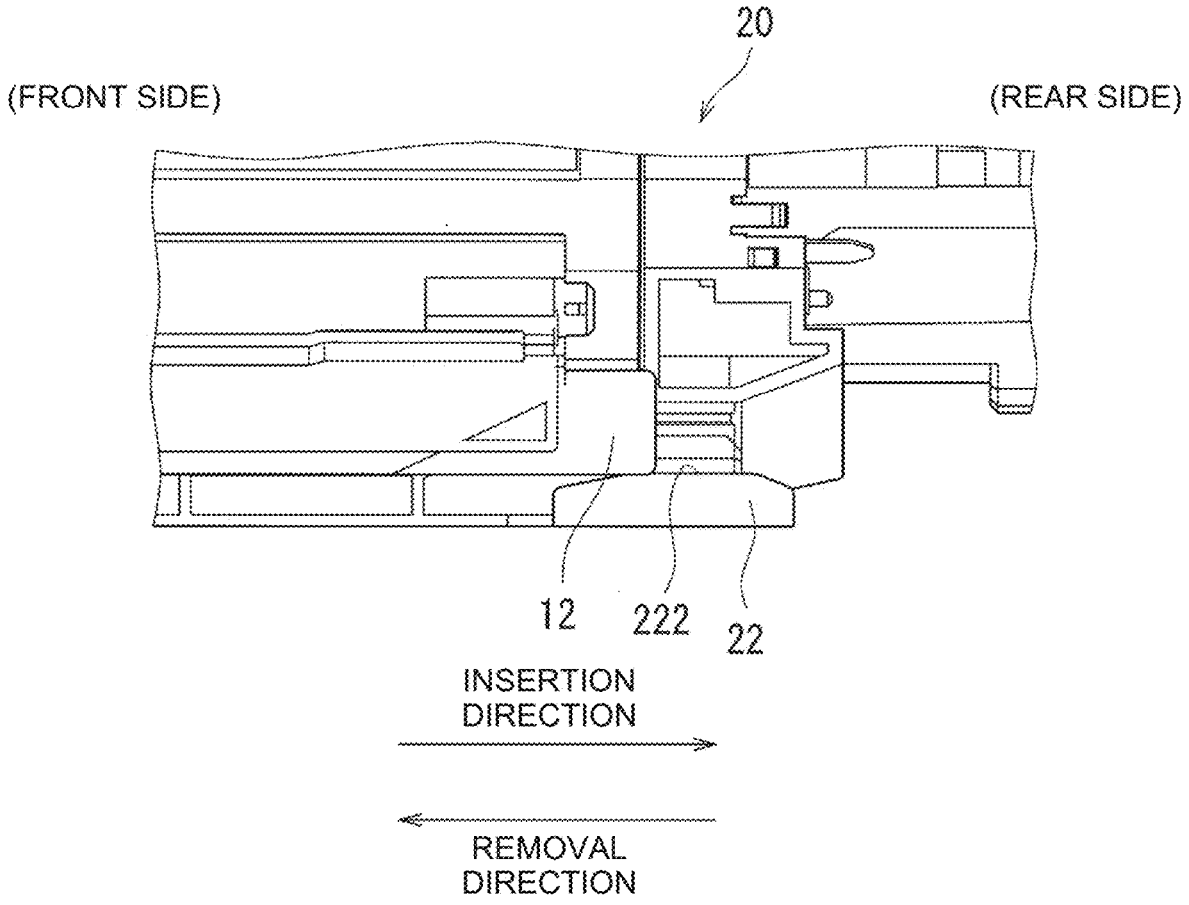
FIG. 7 is a side view in which the developing unit and the foot member of the drum unit in the second state are seen from the drum unit side.
Figure 8:
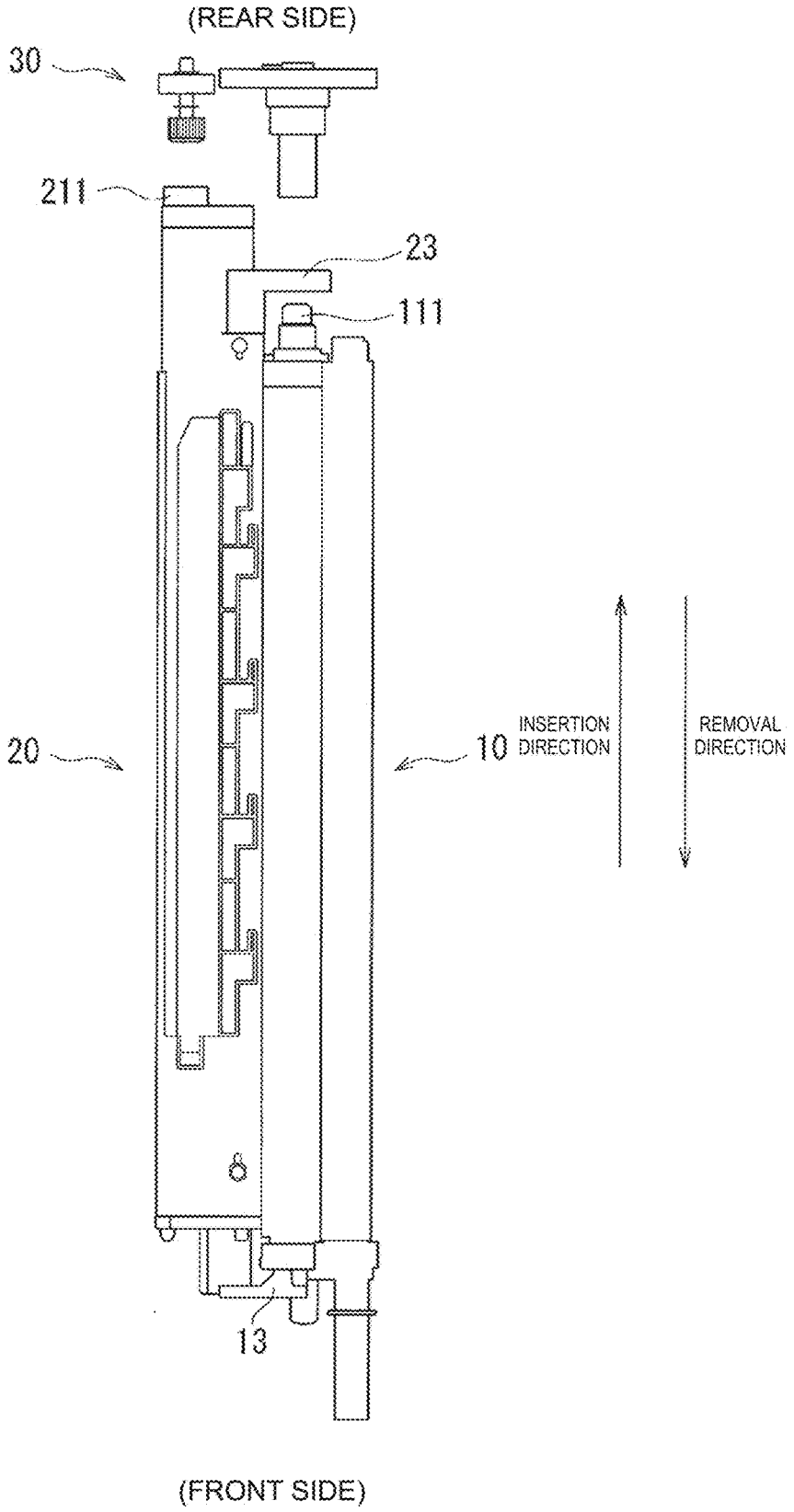
FIG. 8 is a top view of the drum unit and the developing unit in the second state.

FIG. 6 to FIG. 8 each illustrate a state (a second state) where the drum unit 10 is further pressed to the insertion side from the first state and the foot member 12 abuts a front end of the flat surface 222. In the second state, the developing unit 20 fully rises, and the developing unit 20 is brought into the contact state.

Figure 9:
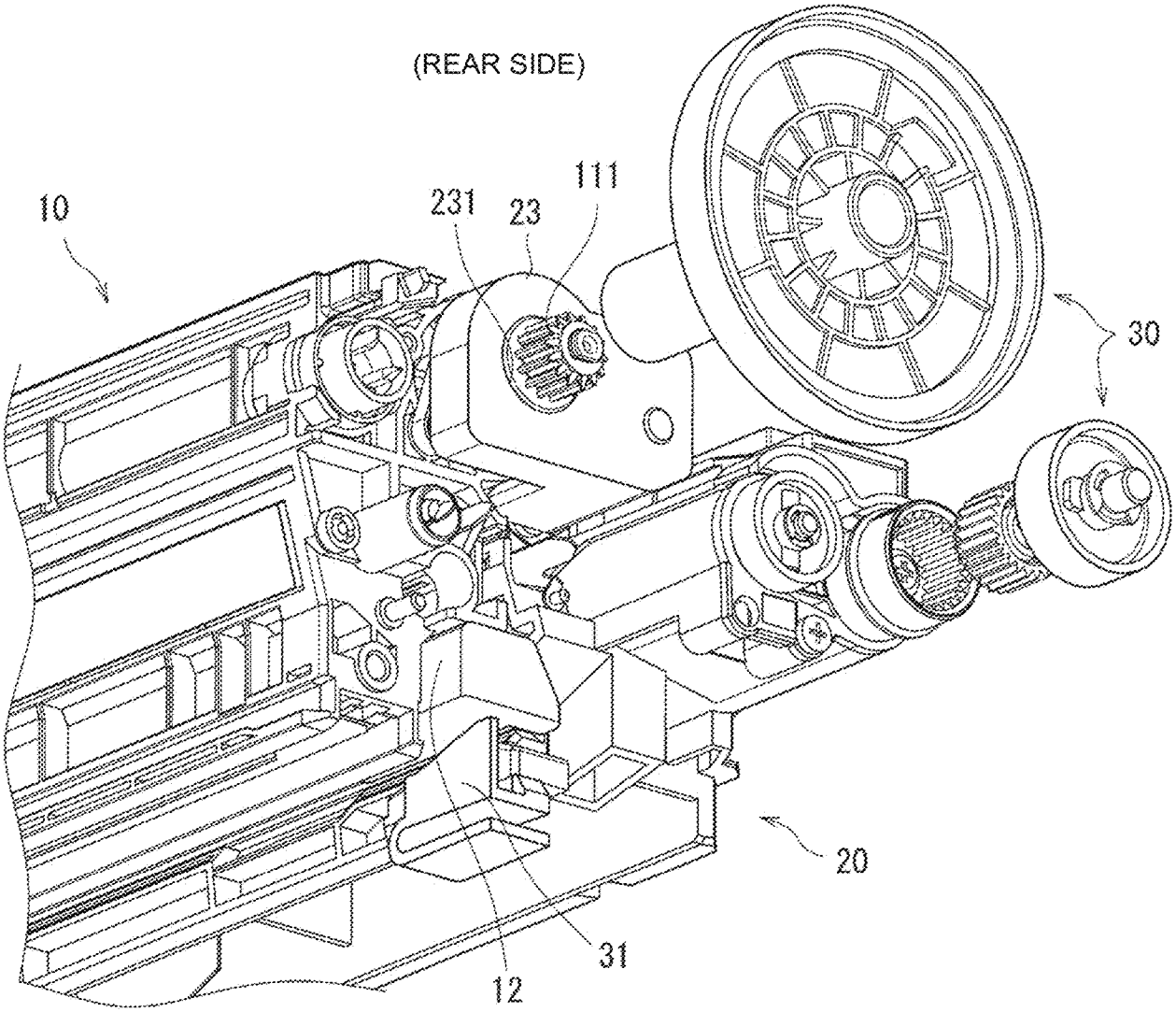
FIG. 9 is a perspective view illustrating the rear ends of the drum unit and the developing unit in a third state.
Figure 10:
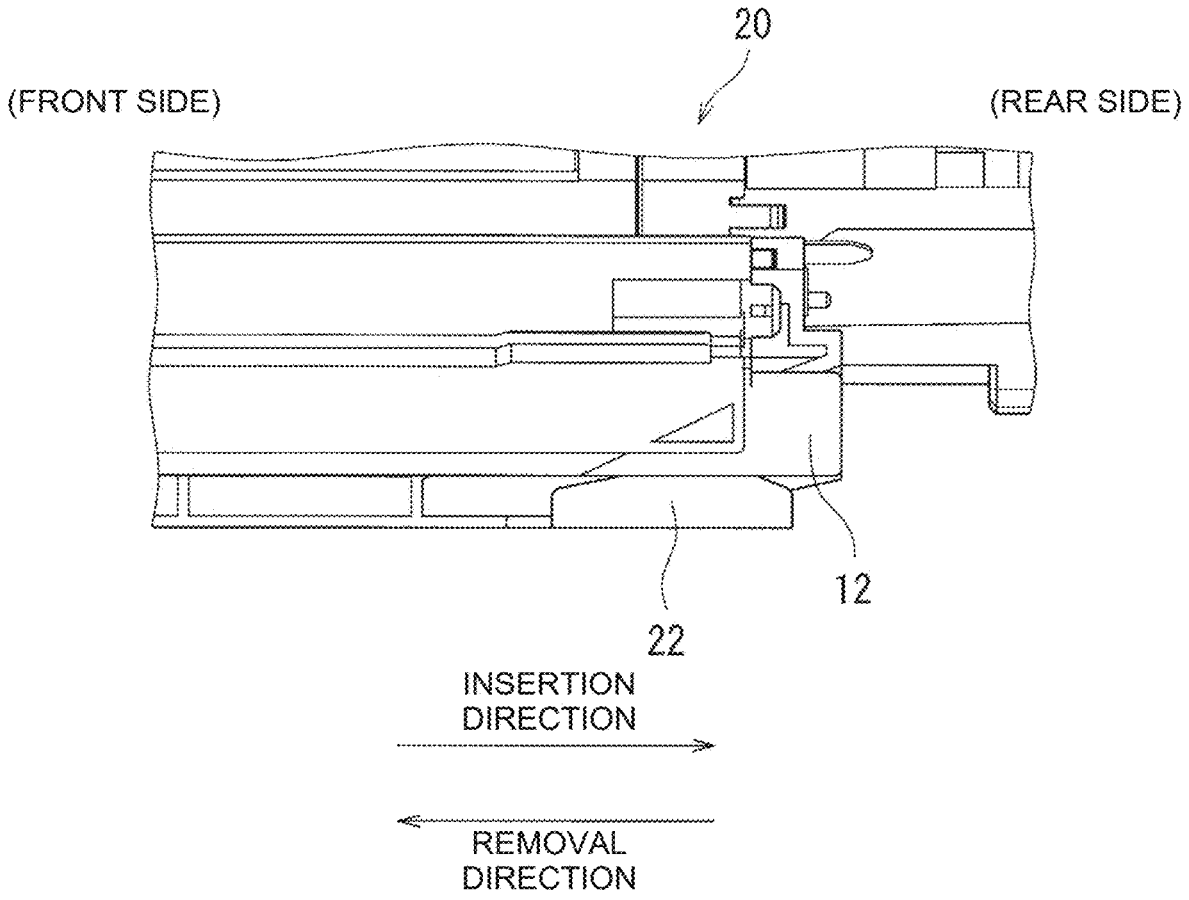
FIG. 10 is a side view in which the developing unit and the foot member of the drum unit in the third state are seen from the drum unit side.
Figure 11:
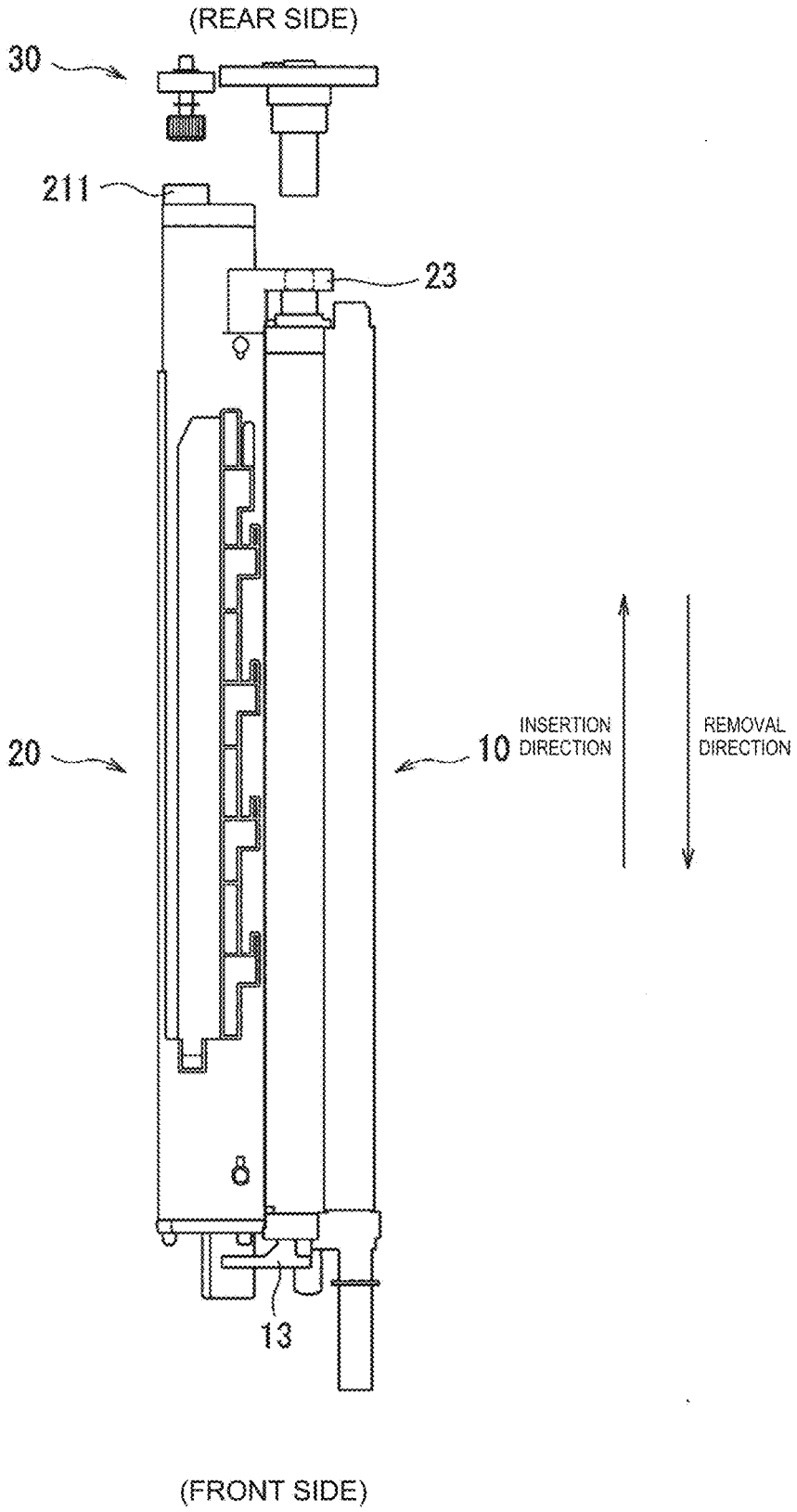
FIG. 11 is a top view of the drum unit and the developing unit in the third state.

FIG. 9 to FIG. 11 each illustrate a state (a third state) where the drum unit 10 is further pressed to the insertion side from the second state, where the foot member 12 passes the flat surface 222, and where the drum unit 10 and the developing unit 20 are positioned with respect to each other. Here, a section from the first state to the third state corresponds to the above-described second section.

Figure 12:
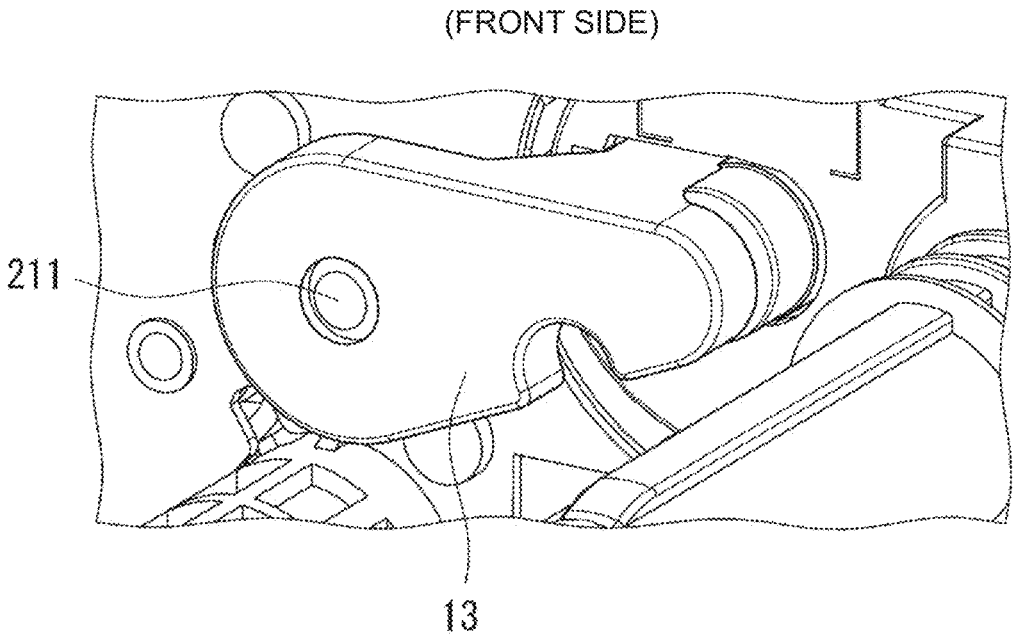
FIG. 12 is a perspective view illustrating front ends of the drum unit and the developing unit in the third state.

In the third state, on the rear side of this apparatus, the drum shaft 111 of the photoreceptor drum 11 is inserted in and positioned by a positioning hole 231 of a rear positioning member (a positioning member) 23. The rear positioning member 23 is a member that is fixed to the developing unit 20. As illustrated in FIG. 12, on the front side of this apparatus, the roller shaft 211 of the developing roller 21 is positioned by a front positioning member (a positioning member) 13. The front positioning member 13 is a member that is fixed to the drum unit 10.

In the third state, although the foot member 12 is not in contact with the abutter 22, the photoreceptor drum 11 and the developing roller 21 are positioned by the positioning members at both ends (on both of the front and rear sides) in the insertion and removal direction. That is, a distance between the drum shaft 111 and the roller shaft 211 (in other words, the gap between the photoreceptor drum 11 and the developing roller 21) is maintained with high precision. However, during a transition from the second state to the third state (in a stroke of about 30 mm), the foot member 12 moves while abutting the flat surface 222 until the above positioning is completed. In this way, the contact state of the developing unit 20 is maintained. The second tapered surface 223 of the abutter 22 is provided as a guide surface for guiding the foot member 12 to the flat surface 222 during the removal operation of the drum unit 10.

Figure 13:
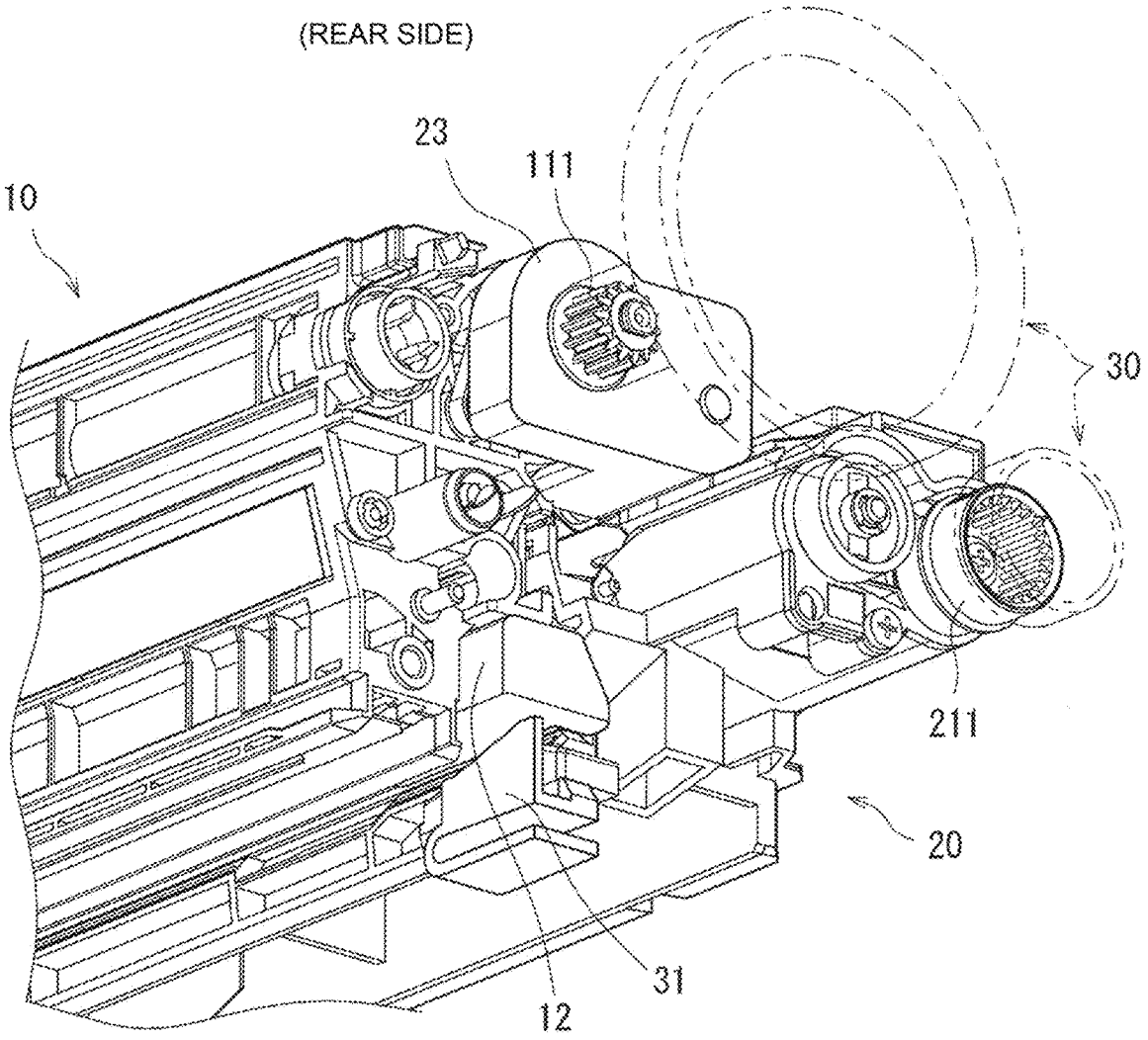
FIG. 13 is a perspective view illustrating the rear ends of the drum unit and the developing unit in a fourth state.
Figure 14:
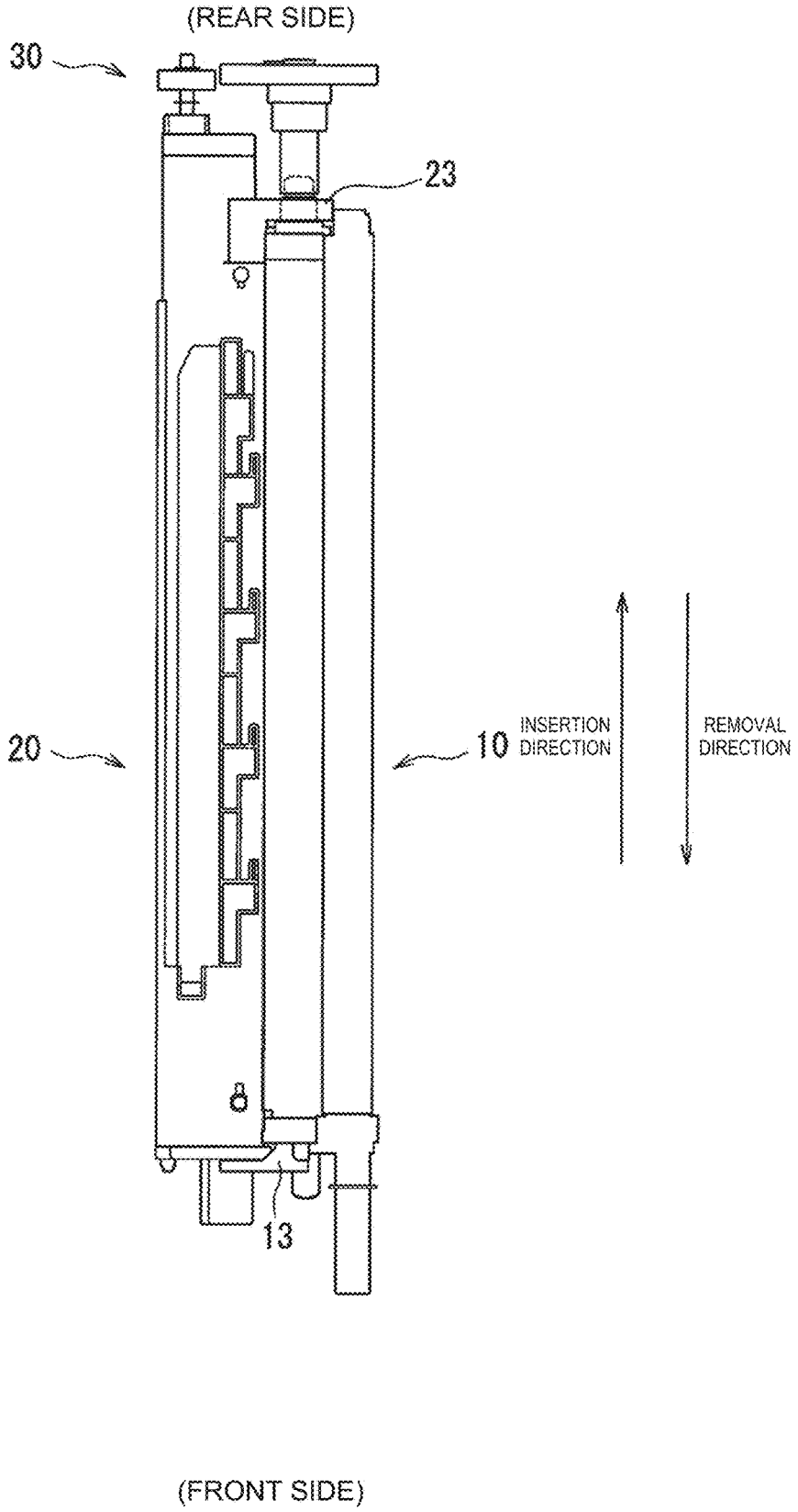
FIG. 14 is a top view of the drum unit and the developing unit in the fourth state.

FIG. 13 and FIG. 14 each illustrate a state (a fourth state) where the drum unit 10 is further pressed to the insertion side from the third state and the installment of the drum unit 10 is completed. In the fourth state, a relative positional relationship between the drum unit 10 and the developing unit 20 is the same as that in the third state, and a positional relationship between the foot member 12 and the abutter 22 is also unchanged from the state illustrated in FIG. 10.

In the fourth state, the drum shaft 111 and the roller shaft 211 are connected to the drive transmission mechanism 30 and thus can transmit the drive power to the photoreceptor drum 11 and the developing roller 21. In FIG. 13, for visual recognition of the drum shaft 111 and the roller shaft 211, the drive transmission mechanism 30 is illustrated by imaginary lines (two-dot chain lines).

During a transition from the third state to the fourth state (in the stroke of about 20 mm), the drum unit 10 and the developing unit 20 are inserted integrally. In other words, a section from the third state to the fourth state corresponds to the above-described first section. During this time, there is no relative movement between the drum unit 10 and the developing unit 20. Accordingly, the surfaces of the photoreceptor drum 11 and the developing roller 21 do not rub against each other, and the surfaces of the photoreceptor drum 11 and the developing roller 21 are not scratched.

The drum shaft 111 and the roller shaft 211 can be connected to the drive transmission mechanism 30 in a state where the developing unit 20 does not rotate. Accordingly, the drive transmission mechanism 30, which is assembled to the apparatus body, does not have to follow the rotation of the developing unit 20 (rotation between the contact state and the separated state), and thus the configuration of the apparatus body can be simplified. Furthermore, in the case where the developing unit 20 adopts a trickle development method, a toner transfer unit for discharging waste toner to the outside is also connected to the developing unit 20. Similar to the drive transmission mechanism 30, the toner transfer unit in this case does not have to follow the rotation of the developing unit 20, and thus the configuration of the apparatus body can be simplified.

In the above insertion operation, the developing unit 20 moves in the insertion direction only during the transition from the third state to the fourth state, and the developing unit 20 does not move in the insertion direction before the third state. This is due to action of the restriction member 31 that is assembled to the apparatus body. A description will hereinafter be made on the action of the restriction member 31 with reference to FIG. 15.

Figure 15:
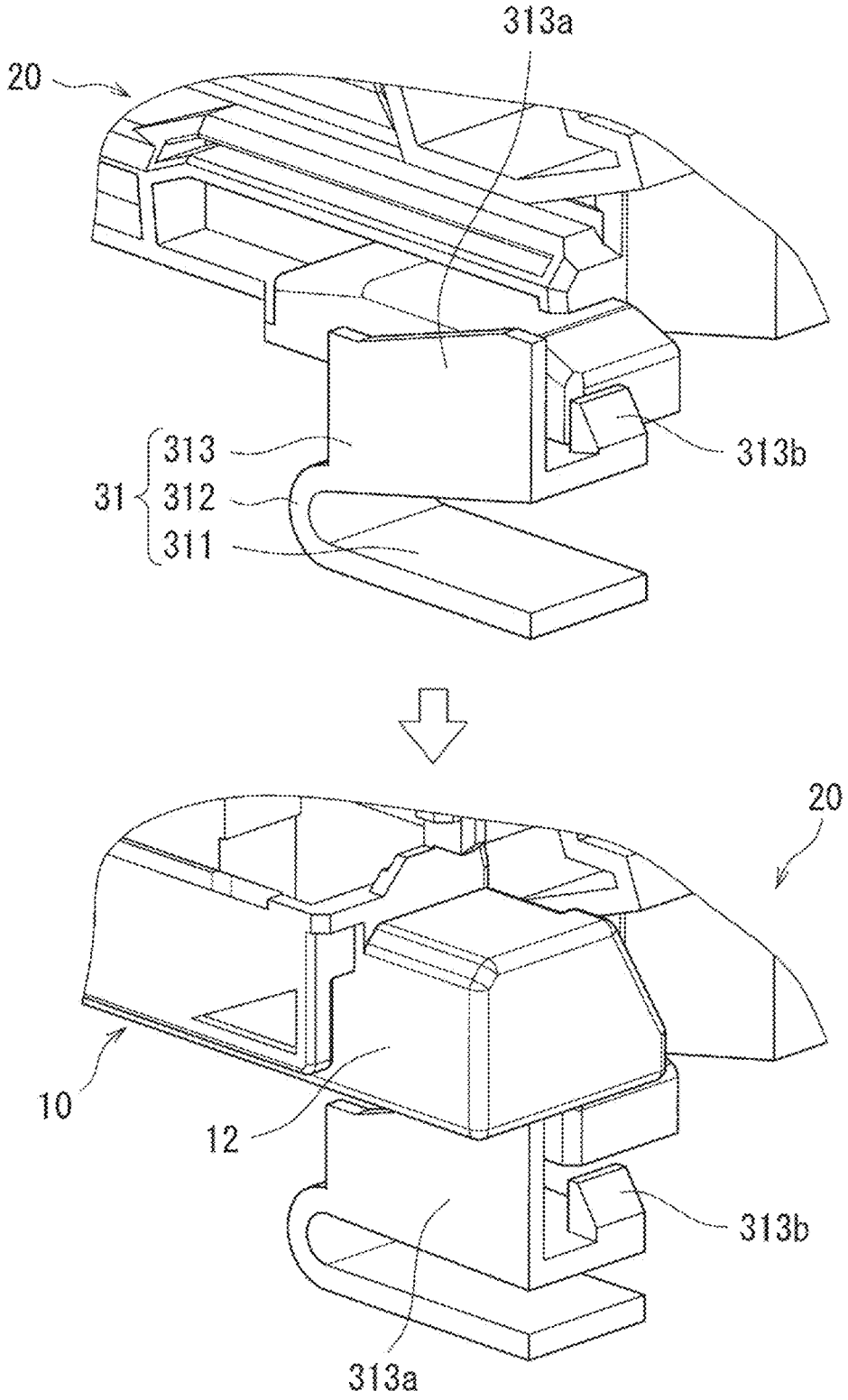
FIG. 15 is a perspective view explaining action of a restriction member.

In an upper portion of FIG. 15, a perspective view (a perspective view seen from the rear side) illustrates the developing unit 20 and the restriction member 31 in a state where the drum unit 10 is removed from this apparatus. The restriction member 31 has a fixture 311 that is fixed to the apparatus body, a plate spring 312, and a mover 313 that is connected to the fixture 311 via the plate spring 312. In addition, the mover 313 is provided with a tapered plate 313*a* and a restriction claw 313*b*. When the drum unit 10 is removed, the restriction member 31 presses the mover 313 toward the developing unit 20 by an urging force of the plate spring 312. At this time, the restriction claw 313*b*, which is provided to the mover 313, is engaged with a part of the developing unit 20 and restricts the movement of the developing unit 20 in the insertion direction. In other words, while the restriction claw 313*b* is engaged with the developing unit 20, the movement of the developing unit 20 in the insertion direction is restricted.

In a lower portion of FIG. 15, a perspective view (a perspective view seen from the rear side) illustrates the drum unit 10, the developing unit 20, and the restriction member 31 at the time when the drum unit 10 is inserted and brought into the third state. In a process of inserting and bringing the drum unit 10 into the third state, a part of the drum unit 10 (the foot member 12 herein) advances while abutting the tapered plate 313*a*, which is provided to the mover 313. Consequently, the mover 313 is pushed down against the urging force of the plate spring 312. Then, in the third state, the restriction claw 313*b* is disengaged from the developing unit 20. After the restriction claw 313*b* is disengaged, the movement of the developing unit 20 in the insertion direction is no longer restricted. During the transition from the third state to the fourth state, the drum unit 10 and the developing unit 20 are inserted integrally.

The removal operation of the drum unit 10 is reversed from the above insertion operation as described above. However, during the transition from the fourth state to the third state, the configuration to remove the drum unit 10 and the developing unit 20 integrally, that is, a mechanism of transmitting the force from the drum unit 10 to the developing unit 20 is required. A description will hereinafter be made on this mechanism with reference to FIG. 16 and FIGS. 17A to 17D.

Figure 16:
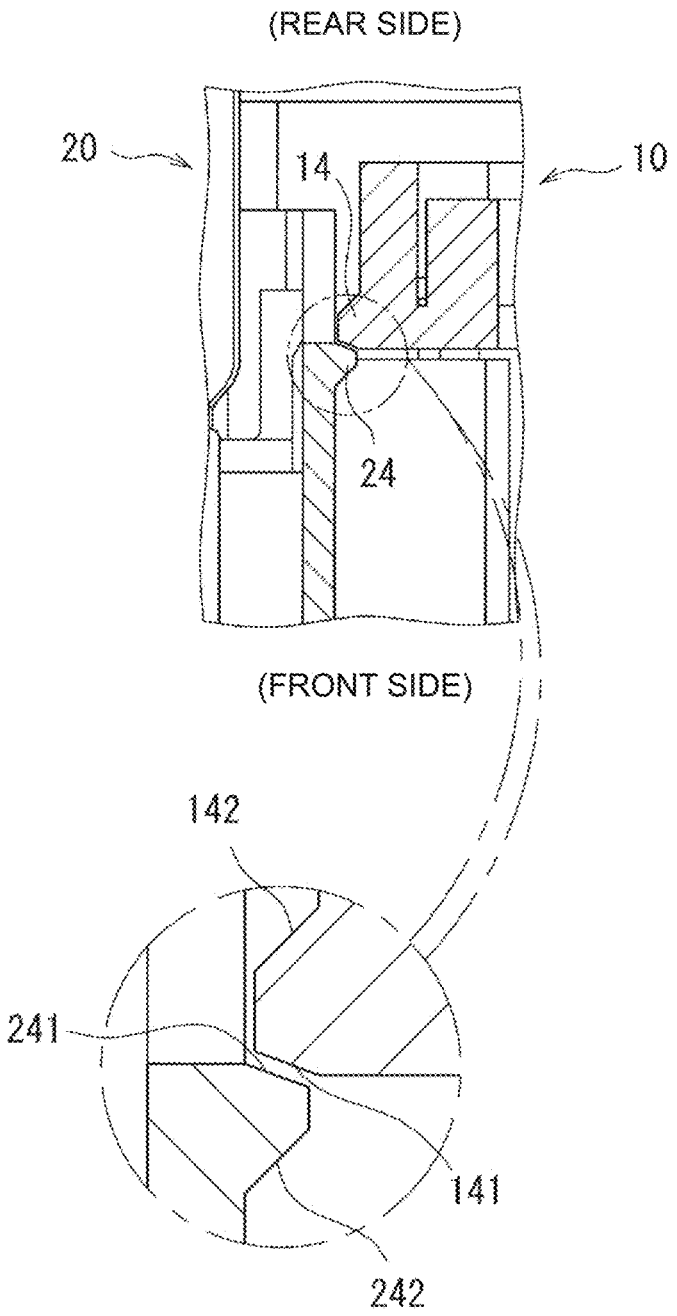
FIG. 16 is an explanatory view illustrating a mechanism that transmits a force from the drum unit to the developing unit during removal operation of the drum unit.

As illustrated in FIG. 16, a surface of the drum unit 10 opposing the developing unit 20 is provided with a drum unit-side engagement projection 14 at an appropriate position. The drum unit-side engagement projection 14 has a removal-side tapered surface 141 on the front side and has an insertion-side tapered surface 142 on the rear side. In addition, the removal-side tapered surface 141 is less inclined than the insertion-side tapered surface 142 (a small inclination to a surface orthogonal to the insertion and removal direction).

A surface of the developing unit 20 opposing the drum unit 10 is provided with a developing unit-side engagement projection 24 at a position corresponding to the drum unit-side engagement projection 14. The developing unit-side engagement projection 24 has a removal-side tapered surface 241 on the rear side, and has an insertion-side tapered surface 242 on the front side. Also, in the developing unit-side engagement projection 24, the removal-side tapered surface 241 is less inclined than the insertion-side tapered surface 242.

When the drum unit 10 and the developing unit 20 are in the fourth state (that is, when the drum unit 10 is installed), as illustrated in FIG. 16, the drum unit-side engagement projection 14 and the developing unit-side engagement projection 24 cause the removal-side tapered surfaces 141, 241 to oppose and contact each other. As described above, the inclinations of the removal-side tapered surfaces 141, 241 are small. accordingly, when the drum unit 10 is removed, the force is easily transmitted from the drum unit 10 to the developing unit 20 via the drum unit-side engagement projection 14 and the developing unit-side engagement projection 24. In this way, in the transition from the fourth state to the third state, the drum unit 10 and the developing unit 20 can be removed integrally.

When the drum unit 10 is inserted, the insertion-side tapered surfaces 142, 242 temporarily oppose and contact each other in the middle of the insertion. At this time, because of the large inclinations of the insertion-side tapered surfaces 142, 242, the drum unit-side engagement projection 14 can easily ride over the developing unit-side engagement projection 24 along the insertion-side tapered surfaces 142, 242.

Similar to the drum unit 10, the developing unit 20, like the drum unit 10, can be inserted into or removed from the apparatus body in the front-rear direction. In addition, the insertion or removal operation of the developing unit 20 is guided by developing unit insertion and removal guides 32*a*, 32*b* provided to the apparatus body and guide grooves 25*a*, 25*b* formed in the developing unit 20 (see FIGS. 1 and 2). The developing unit insertion and removal guide 32*a* and the guide groove 25*a* are provided on the surface side of the developing unit 20 opposing the drum unit 10, and the developing unit insertion and removal guide 32*b* and the guide groove 25*b* are provided on an opposite side of the drum unit 10.

The guide groove 25*a* on the surface side opposing the drum unit 10 is formed as a single linear groove that is parallel to the insertion and removal direction. Meanwhile, the guide groove 25*b* on the opposite side of the drum unit 10 is in a shape capable of assisting the rotation of the developing unit 20. FIGS. 17A to 17D are each a side view illustrating a state change of the guide groove 25*b* and the developing unit insertion and removal guide 32*b* in association with the movement of the developing unit 20 in the insertion and removal direction. In FIGS. 17A to 17D, the developing unit 20 moves in the removal direction as the state is shifted from FIG. 17A to FIG. 17D.

As illustrated in FIGS. 17A to 17D, the guide groove 25*b* has a first groove 251 and a second groove 252, and the second groove 252 is provided below the first groove 251. The first groove 251 is formed as a linear groove that is parallel to the insertion and removal direction and has a length in which the insertion or removal operation of the developing unit 20 can be guided throughout an entire area. Meanwhile, the second groove 252 has a length in which the developing unit 20 can be guided between the fourth state and the third state. The first groove 251 and the second groove 252 are divided in a rotational direction of the developing unit 20 on the front side. However, on the rear side, the first groove 251 and the second groove 252 are coupled in the rotational direction of the developing unit 20.

Figure 17A:
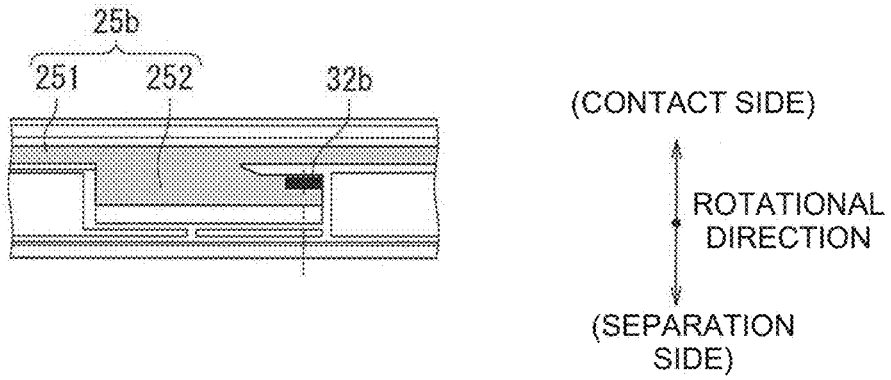
FIGS. 17A to 17D are each a side view illustrating a state change between a guide groove and a developing unit insertion and removal guide in association with movement of the developing unit in an insertion and removal direction.
Figure 17B:
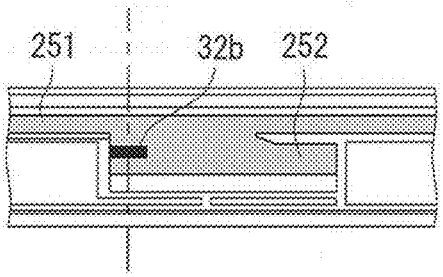

Here, FIG. 17A corresponds to the fourth state, and FIG. 17B corresponds to the third state. Since the developing unit 20 is in the contact state from the fourth state to the third state, the developing unit insertion and removal guide 32*b* moves within the guide groove 25*b* along the second groove 252.

When the developing unit 20 is in the third state, the developing unit insertion and removal guide 32*b* abuts a rear end of the second groove 252. When a user further pulls the drum unit 10 to the removal side from this state, the developing unit 20 cannot move toward the removal side any further. Thus, the drum unit-side engagement projection 14 rides over the developing unit-side engagement projection 24 along the removal-side tapered surfaces 141, 241. Thereafter, the drum unit 10 can be removed solely.

Figure 17C:
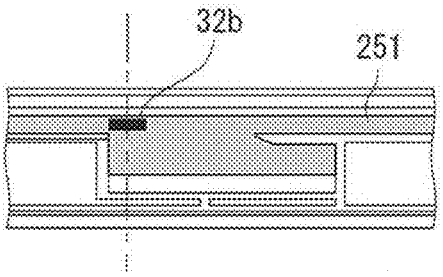

FIG. 17C corresponds to the first state. Since the drum unit 10 moves independently from the third state to the first state, the developing unit 20 does not move in the insertion and removal direction. However, in the first state, the developing unit 20 rotates to the separated state. Thus, the developing unit insertion and removal guide 32*b* also moves to the first groove 251 in the guide groove 25*b*.

Figure 17D:
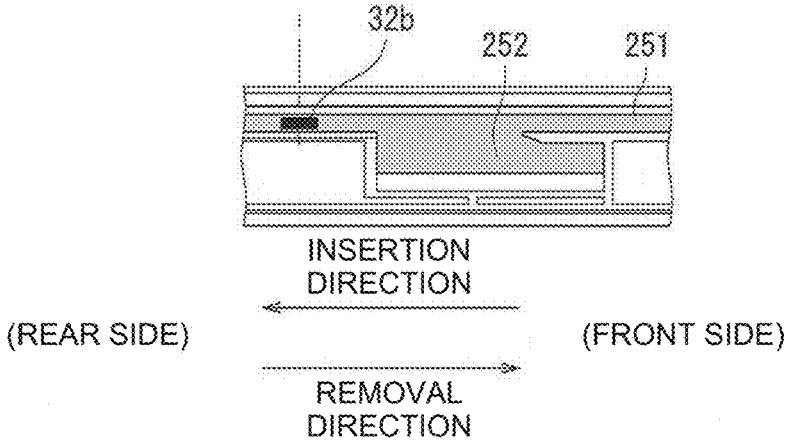

FIG. 17D illustrates a state where the developing unit 20 is further removed from the first state. In other words, when the developing unit 20 is further removed from the first state, the developing unit insertion and removal guide 32*b* moves within the guide groove 25*b* along the first groove 251. In this way, the developing unit 20 can completely be removed from the apparatus body.

The developing unit 20 is inserted into or removed from the apparatus body in a state where the drum unit 10 is removed from the apparatus body. At this time, the insertion operation of the developing unit 20 can only be performed up to the state illustrated in FIG. 17C. This is because the insertion of the developing unit 20 is restricted by the restriction member 31. In other words, it is impossible to insert the developing unit 20 alone to the innermost side.

As it has been described so far, in this apparatus, when the drum unit 10 is inserted into or removed from the apparatus body, there is no need to switch between the separation and the contact of the developing unit 20 from and with the drum unit 10 by the lever operation or the like. Thus, it is possible to simplify the configuration of this apparatus, which contributes to cost reduction.

Second Embodiment

In the imaging forming apparatus described in the first embodiment, the developing unit 20 rotates to the separation side by the own weight. However, the present disclosure is not limited thereto. The developing unit 20 may receive the urging force from an elastic member such as a spring and thereby rotate to the separation side. In this way, regardless of the positional relationship between the developing unit 20 and the drum unit 10, the present disclosure can be applied.

The embodiments disclosed herein are illustrative in all respect, and are not the basis for limited construal. Therefore, the technical scope of the present disclosure is not construed only by the embodiments described above but defined on the basis of recitation in the claims. All modifications within the meaning and the scope equivalent to the claims fall within the scope of the present disclosure.

For example, in the above description, the developing unit 20 contacts or is separated from the drum unit 10 by the abutment between the first tapered surface 221 provided in the developing unit 20 and the foot member 12 in the drum unit 10. In other words, the taper described in the claims is configured to be provided to the developing unit 20. However, the present disclosure is not limited thereto, and the taper may be provided to the drum unit 10. In other words, the drum unit 10 is inserted or removed while the taper provided to the drum unit 10 abuts the part of the developing unit 20. In this way, it is possible to switch between the separation and the contact of the developing unit 20 from and with the drum unit 10.

What is claimed is:

1. An image forming apparatus having a photoreceptor drum unit and a developing unit attachable to and detachable from an apparatus body, wherein when the photoreceptor drum unit is inserted into or removed from the apparatus body, operation in first to third sections occurs in a stated order or in an order reverse to the stated order, (1) a first section is a predetermined section on a removal side from an innermost position of the photoreceptor drum unit, and in the first section, the developing unit is inserted or removed integrally with the photoreceptor drum unit;

(2) a second section is a predetermined section on the removal side from the first section, only the photoreceptor drum unit is inserted or removed in the second section, and meanwhile, the developing unit gradually rotates to switch contact or separated states in conjunction with insertion or removal of the photoreceptor drum unit, and when the photoreceptor drum unit is inserted, the developing unit is switched from the separated state to the contact state, and when the photoreceptor drum unit is removed, the developing unit is switched from the contact state to the separated state; and (3) a third section is a predetermined section on the removal side from the second section, and in the third section, only the photoreceptor drum unit is inserted into or removed from the apparatus body in the separated state of the developing unit.

2. The image forming apparatus according to claim 1, wherein one of the developing unit and the photoreceptor drum unit has a taper on a surface side opposing the other one of the developing unit and the photoreceptor drum unit, and in the second section, a part of the other of the developing unit and the photoreceptor drum unit moves while abutting the taper, thereby applies a rotational force that causes the developing unit to move into the contact state during insertion of the photoreceptor drum unit, and cancels the rotational force during removal of the photoreceptor drum unit.

3. The image forming apparatus according to claim 1, wherein at a boundary between the first section and the second section, a photoreceptor drum of the photoreceptor drum unit and a developing roller of the developing unit are positioned by positioning members at both ends in an insertion and removal direction.

4. The image forming apparatus according to claim 1, wherein the developing unit rotates to a separation side from the photoreceptor drum unit by own weight.

5. The image forming apparatus according to claim 1, wherein the developing unit receives an urging force from an elastic member and rotates to a separation side from the photoreceptor drum unit.

6. An image forming apparatus having a photoreceptor drum unit and a developing unit attachable to and detachable from an apparatus body, the image forming apparatus comprising:

a developing unit guide that guides the developing unit in an insertion and removal direction and allows the developing unit at a predetermined position in the insertion and removal direction to rotate in order to switch between a contact state with and a separated state from the photoreceptor drum unit;

a taper that is provided to one of the developing unit and the photoreceptor drum unit, is provided on a surface side opposing the other of the developing unit and the photoreceptor drum unit, in a state where the developing unit is located at the predetermined position, abuts a part of the other one of the developing unit and the photoreceptor drum unit during insertion or removal of the photoreceptor drum unit so as to apply a rotational force that causes the developing unit to move into the contact state during the insertion of the photoreceptor drum unit, and cancels the rotational force during the removal of the photoreceptor drum unit, and thereby causes the developing unit to move into the separated state;

a positioning member that fixes positions of a developing roller of the developing unit and a photoreceptor drum of the photoreceptor drum unit in a state where the developing unit and the photoreceptor drum unit are in contact with each other;

a restriction member that is provided to the apparatus body, restricts movement of the developing unit from the predetermined position to an insertion side in a state where the developing unit and the photoreceptor drum unit are not in contact with each other, and cancels the movement restriction of the developing unit in the state where the developing unit and the photoreceptor drum unit are in contact with each other; and engagement projections that are provided to both of the developing unit and the photoreceptor drum unit, engage with each other at the time of removing the photoreceptor drum unit that is installed in the apparatus body, and can transmit a force in a removal direction from the photoreceptor drum unit to the developing unit while the developing unit moves from a position in an installed state to the predetermined position.

7. The image forming apparatus according to claim 6, wherein the developing unit guide includes: a guide groove that is provided at least on an opposite side of the photoreceptor drum unit and is formed in the developing unit; and a developing unit insertion and removal guide provided to the apparatus body, the guide groove has: a first groove in such a length that can guide insertion or removal operation of the developing unit throughout an entire area; and a second groove in such a length that can guide the insertion or removal operation of the developing unit in a predetermined section, the first groove and the second groove are divided in a rotational direction of the developing unit on a front side of the apparatus body and are coupled in the rotational direction of the developing unit on a rear side of the apparatus body, and when the developing unit is at the predetermined position, the developing unit guide causes relative movement of the developing unit insertion and removal guide in the rotational direction at a position between the first groove and the second groove, and can thereby switch between the contact state and the separated state of the developing unit.

8. The image forming apparatus according to claim 6, wherein the positioning member includes: a rear positioning member that is provided on a rear side of the developing unit and positions a drum shaft of the photoreceptor drum; and a front positioning member that is provided on a front side of the photoreceptor drum unit and positions a roller shaft of the developing roller.

9. The image forming apparatus according to claim 6, wherein the engagement projection includes:

a drum unit-side engagement projection that is provided to the photoreceptor drum unit, has a removal-side tapered surface on a front side, and has an insertion-side tapered surface on a rear side; and a developing unit-side engagement projection that is provided to the developing unit, has a removal-side tapered surface on the rear side, and has an insertion-side tapered surface on the front side, and the removal-side tapered surface has a smaller inclination than the insertion-side tapered surface.

* * * * *